US005090739A

United States Patent [19]

Pollard

[11] Patent Number: 5,090,739

[45] Date of Patent: Feb. 25, 1992

[54] PLUMBING SLEEVE

[76] Inventor: Donald K. Pollard, 36 Carmichael Crescent, Collingwood, Ontario, Canada, L9Y 4P5

[21] Appl. No.: 551,017

[22] Filed: Jul. 11, 1990

[51] Int. Cl.[5] ..... F16L 11/12

[52] U.S. Cl. ..... 285/56; 285/60; 285/383; 285/423; 285/915

[58] Field of Search ..... 285/56, 57, 58, 59, 285/60, 138, 383, 417, 423, 915; 52/219, 220; 4/252 R, 295; 138/109, 177, 178, 148

[56] References Cited

U.S. PATENT DOCUMENTS

| | | | |
|---|---|---|---|
| 3,598,430 | 8/1971 | Maher et al. | 285/423 X |
| 3,800,486 | 4/1974 | Harvey | 52/220 X |
| 3,911,508 | 10/1975 | Goldberg | 4/295 X |
| 4,261,598 | 4/1981 | Cornwall | 285/64 |
| 4,619,471 | 10/1986 | Harbeke | 285/915 X |
| 4,669,759 | 6/1987 | Harbeke | 52/220 X |

FOREIGN PATENT DOCUMENTS

| | | | |
|---|---|---|---|
| 680724 | 2/1964 | Canada | 72/75 |
| 767536 | 9/1967 | Canada | 285/62 |
| 1162210 | 2/1984 | Canada | 285/23 |

*Primary Examiner*—Randolph A. Reese
*Assistant Examiner*—Heather Chun
*Attorney, Agent, or Firm*—Cushman, Darby & Cushman

[57] ABSTRACT

A pipe coupling is described suitable for joining together drainage, or other, plastic piping through a poured concrete layer, typically a floor. The coupling permits precise location of fittings, such as a toilet flange, after the concrete has been poured and set.

1 Claim, 1 Drawing Sheet

PLUMBING SLEEVE

BACKGROUND OF THE INVENTION

This invention is concerned with a plumbing sleeve suitable for connecting to a toilet, or other relatively fixed installation, placed on a concrete floor.

In many buildings and similar structures concrete floors are used to which various plumbing fixtures, particularly toilets, have to be attached. Generally speaking, a piping connection will extend substantially vertically downwardly through the floor, thus connecting the toilet or other fixture above it to a sanitary or sewer main below it. It is usual practice to place the piping connection in position before the concrete comprising the floor is poured and allowed to set into place around it, inherently securing the piping connection in place. However, once the concrete has been poured and has set, any adjustment to the piping connection becomes impossible. This is particularly important for a toilet, where a sanitary connection is absolutely necessary. Once any flange or cap has been placed, and the cement set, it is effectively immovable. On the other hand, it is extremely difficult to pour concrete for a floor to an exact and predetermined height. In other words, when placing such a piping connection it is almost impossible to predetermine with sufficient accuracy to guarantee the required sanitary joint exactly where that joint is going to be.

There are two types of concrete floor or other surface which have to be considered: those where there is a free space below, such as an intermediate floor in a high-rise building, and those where there is no free space below, such as a slab placed on grade. Floors with a space below them are poured, generally, onto some form of supported wooden shuttering. Various proposals have been made to facilitate placement of a vertical sanitary, drain or sewer pipe in such floors. Morell, in Canadian Patent 680,724 describes a pipe sleeve structure which is essentially a short tube having a radially outwardly extending flange at one end. The sleeve is of flexible plastic, the flange has a plurality of centering openings and the tube has a length less than the thickness of the floor to be laid. In use, the sleeve is nailed to the wood shuttering, and thus appears to serve primarily to locate the position of the desired hole. A conventional pipe is placed into the short tube. Morell is silent as to what happens to the sleeve when the shuttering (to which it is nailed) is removed. A similar device is described by Hagedorn in Canadian Patent 767,536.

A more complex arrangement is described by Cornwall in Canadian Patent 1,162,21. In this coupling, a three part system is used comprising a coupling part which is at least temporarily supported by the shuttering. Conventional piping is inserted from both above and below, to the top end of which is attached a suitable fitting, for example to attach a toilet thereto. Again, the coupling is nailed in place onto the shuttering, and the upper fitting placed thereon before the floor is poured.

Thus none of these devices appear to address the problem of floor thickness variation, nor do they appear to be applicable to a slab which is not poured onto shuttering. It is thus apparent that a need exists for a simple pipe sleeve unit which can be used in concrete floors which are not poured onto shuttering. Advantageously such a sleeve should also be amenable to use in situations where shuttering is used.

SUMMARY OF THE INVENTION

Thus this invention provides a plastic coupling for plastic pipes which is adapted to be embedded in concrete or the like. The adapter consists of a substantially cylindrical tube, having substantially concentric inside and outside walls. One end of the adapter has a larger internal diameter than the other, the two ends being joined together by an intermediate radial flange. The narrower end of the coupling includes an internal annular rib, having two spaced shoulders, which separates the narrower end into two parts. These two parts are sized to mate with the outside diameters of the two plastic pipes to be coupled by the coupling. The shoulders of the internal annular rib have a height such that the internal diameter of the rib is substantially the same as the internal diameter of the smaller of the plastic pipes being coupled. The wider end of the coupling has an internal diameter greater than the outside diameter of the pipe which passes through it to enter into the ends of the narrower part of the coupling adjacent the internal flange.

BRIEF DESCRIPTION OF THE DRAWINGS

The invention in one embodiment will now be described by way of the embodiment shown in the drawings in which.

DESCRIPTION OF THE PREFERRED EMBODIMENTS

Figure 1:
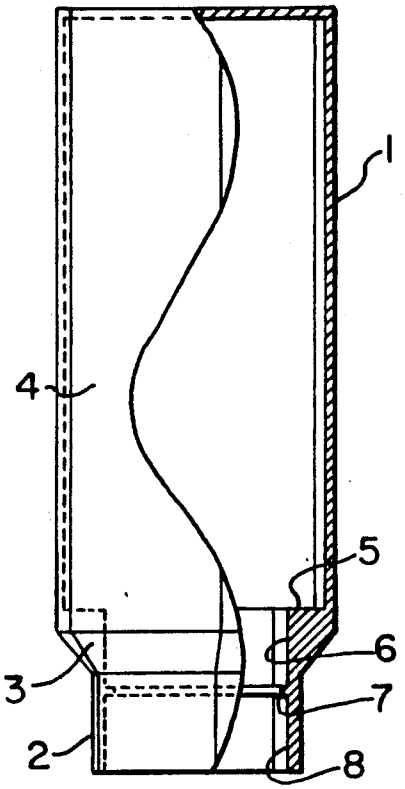
FIG. 1 shows a typical coupling, partly in cross-section.

Referring first to FIG. 1, the coupling shown generally at 1 which is generally cylindrical in shape, consists essentially of three parts: a narrower first tube part 2, an intermediate radial flange 3, and a wider second tube part 4. As can be seen from the cross-section in the figure, the second tube part 4 has a plain internal wall for its full length down to the inside upper face 5 of the flange 3. The bore of the narrower first tube part 2 is divided into a first wall 6 adjacent to, and as shown incorporating the inside face of, the radial flange 3, an internal rib 7, and a second wall 8. The internal rib 7 as shown has a square cross-section. Its height, as will be seen more fully below with respect to FIG. 2, corresponds to the wall thickness of the pipes to be inserted into the narrower tube, from each end thereof.

Figure 2:
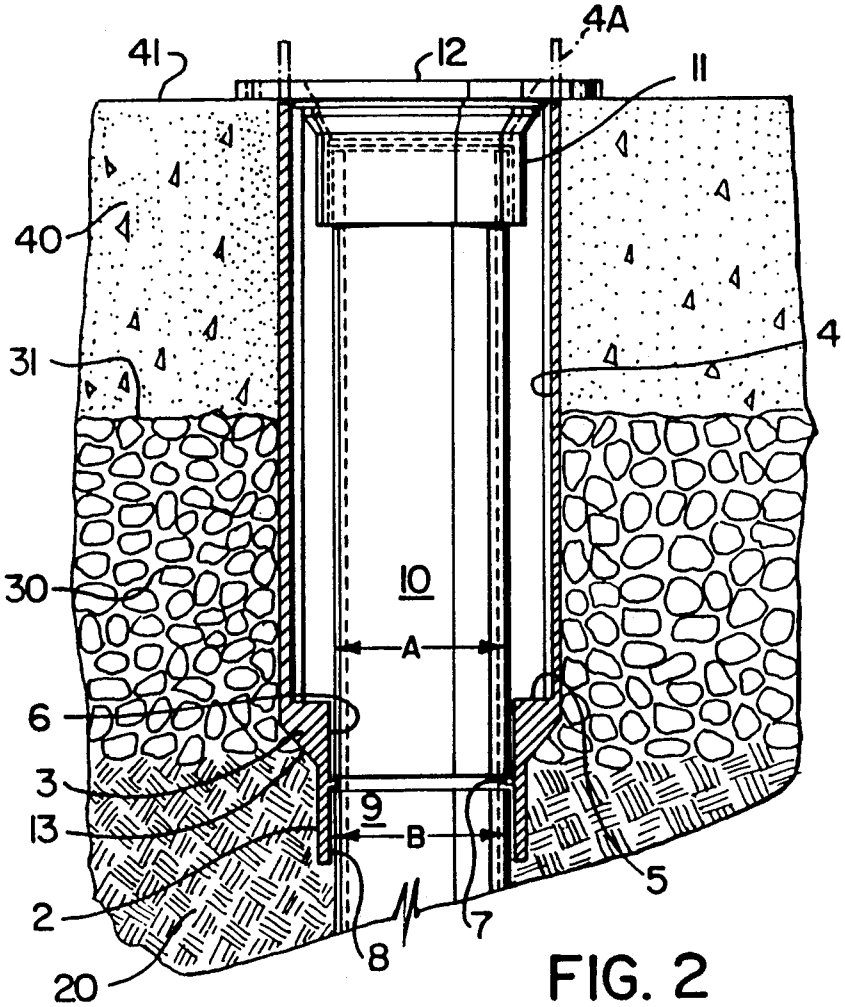
FIG. 2 shows the coupling of FIG. 1 installed in a concrete floor.

In FIG. 2, the coupling is shown installed and attached to the base of a toilet, through an on-grade concrete floor. The method of installation is as follows. First, an underground sanitary sewer connection pipe 9 is placed in the subsoil 20 in the desired location. The sleeve shown generally at 1 is then placed over and cemented to the pipe end 9, with the cut end of the pipe mating to, and cemented to, the second wall 8 of the narrower portion, 2, of the coupling. The cut end, as shown, substantially abuts the internal rib 7. At this stage, the wider tube 4, of the coupling 1 will protrude beyond the desired final surface level 41 of the layer of concrete 40. After the coupling is placed, any desired gravel layer, as at 30, is placed, followed by a water impervious membrane if required, as at 31 (which will also usually be sealed with grout or adhesive to the coupling) and by the concrete 40, which is finished by trowelling or the like to provide a final surface 41. In many such installations, a layer of ceramic tile will be laid onto the concrete: in that case 41 will represent the final top surface of the tiles. In other words, a final use surface 41 is provided on top of the concrete 40. At this stage, the extra length of the coupling (shown ghosted at 4A) will still protrude beyond the surface 41.

The next step is to trim back the excess protruding length of the upper part of the coupling, that is the part ghosted at 4A, to be flush with the final surface 41 of the concrete floor. A length of standard pipe 10 is then mated into, and cemented to, the first wall section 6 in the smaller tube 2. To the top of pipe 10 is attached a standard toilet flange 11, by cementing. The toilet, the base of which is shown generally at 12, is then located on the floor and anchored by means of conventional bolts and the like, which will include a suitable sealed connection (not shown) to the toilet flange 11.

It can thus be seen that the sleeve of this invention by placing the necessary pipe joint well below floor level permits the insertion between the above-floor unit for which drainage is required and the pipe coupling of a short length of normal pipe. It is a straightforward matter to cut this pipe to exactly the required length after the concrete has been poured, has set, and (where relevant) has had a final surface applied, for example ceramic tiles.

Although described above in terms of attaching a toilet to a sub-floor and below grade sanitary pipe of the same diameter as the toilet pipe, this invention is not limited to that situation. In many applications the outside diameter B of the subsoil pipe will differ from the outside diameter A of the conventional house pipe: the subsoil pipe may well be a thin wall polythene pipe, and the house pipe a thick-wall ABS pipe; further the subsoil pipe may be of a different nominal internal diameter to the conventional pipe, which again will change the outside diameter. The coupling can also be used in situations where the concrete is to be laid onto shuttering. In that case, the taper in the coupling 13 will serve to centralize the coupling in the aperture provided in the shuttering. It can also be used for items other than a toilet (for example, a floor drain), and can also be used in positions other than substantially vertical.

I claim:

1. A one-piece plastic coupling for two plastic pipes, each having an internal and an external diameter, adapted to be embedded through concrete consisting of a substantially cylindrical tube having substantially concentric inside and outside walls, which comprises a first tube part, a second tube part of larger internal diameter than the first tube part, and an intermediate integral radial flange joining the first and second tube parts together, wherein:

(a) the first tube part includes a first inside wall adjacent the intermediate flange, and a second inside wall separated from the first inside wall by an internal annular rib wherein each of the internal diameters of the first inside wall and of the second inside wall mate with the external diameters of the pipes to be coupled, and wherein the internal rib has a height such that the internal diameter of the internal rib is substantially the same as the internal diameter of the smaller of the two plastic pipes to be coupled;

(b) the second tube part has an internal diameter greater than the external diameter of the pipe entering the first inside wall of the first tube part;

(c) the integral radial flange is adjacent the internal annular rib which separates the first and the second inside walls; and (d) the integral radial flange tapers outwardly from the outside diameter of the first tube part to the outside diameter of the second tube part;

and wherein the taper serves to centralize the coupling.

* * * * *